US006408146B1

(12) United States Patent
Nagano

(10) Patent No.: US 6,408,146 B1
(45) Date of Patent: Jun. 18, 2002

(54) IMAGE HEATING APPARATUS

(75) Inventor: Toshiyuki Nagano, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/558,169

(22) Filed: Apr. 26, 2000

(30) Foreign Application Priority Data

Apr. 23, 1999 (JP) ..... 11-122173
Jun. 10, 1999 (JP) ..... 11-163631
Apr. 25, 2000 (JP) ..... 2000-124060

(51) Int. Cl.[7] ..... G03G 15/20; G03G 15/00
(52) U.S. Cl. ..... 399/67; 399/328
(58) Field of Search ..... 399/67, 68, 328, 399/329, 333, 307; 219/216; 198/810.01; 226/45

(56) References Cited

U.S. PATENT DOCUMENTS 5,043,770 A 8/1991 Nagano et al. ..... 399/392
5,752,148 A * 5/1998 Yoneda et al. ..... 399/329
5,819,149 A * 10/1998 Watanabe et al. ..... 399/68 X
6,141,522 A * 10/2000 Tsuruoka et al. ..... 399/302
6,175,713 B1 * 1/2001 Uehara et al. ..... 399/307

FOREIGN PATENT DOCUMENTS

JP 02-163788 * 6/1990
JP 5-19653 1/1993
JP 7-261584 10/1995
JP 8-190298 7/1996
JP 11-316506 * 11/1999

* cited by examiner

*Primary Examiner*—Sophia S. Chen
(74) *Attorney, Agent, or Firm*—Fitzpatrick, Cella, Harper & Scinto

(57) ABSTRACT

The present invention relates to an image heating apparatus that has a rotary member contacting with a recording material bearing an image thereon, a marking portion provided on the rotary member, and detecting device for detecting a rotational speed of the rotary member by reflected light from the marking portion, and the image on the recording material is heated by heat from the rotary member side, and the marking portion has a mixture of an adhesive agent and a reflective material.

39 Claims, 14 Drawing Sheets

IMAGE HEATING APPARATUS

BACKGROUND OF THE INVENTION

1. Field of the Invention

This invention relates to an image heating apparatus applied to an image forming apparatus such as a copier a printer or the like, and particularly to a apparatus for detecting the rotational speed of a rotary member.

2. Related Background Art

Heretofore, in an image forming apparatus such as a copier, LBP, a facsimile apparatus, a microfilm reader printer, an image display apparatus or a recording machine, as a heating apparatus (an image heating apparatus or an image heating and fixing apparatus) for heating and fixing on the surface of a recording material (such as a transfer material sheet, an electrofax sheet, an electrostatic recording sheet or printing paper) an unfixed toner image corresponding to desired image information formed and borne on the surface of the recording material by an indirect (transfer) method or a direct method by suitable image process means such as electrophotography, electrostatic recording or magnetic recording as a permanent fixed image by the use of a bisualizing agent (toner) comprising heating meltable resin or the like, use has often been made of a heat roller system for heating the recording material as a material to be heated by a heating roller as a heating member maintained at a predetermined temperature and a pressing roller as a pressing member having an elastic layer and urged against the heating roller while pinching and conveying the recording material therebetween.

Besides this, various systems such as a flash heating system, an open heating system and a heat plate heating system are known and practically used.

Recently, instead of these systems, there has been devised a heating apparatus (film heating system) of a type which has a fixed and supported heating member, heat-resisting film (fixing film) conveyed while being urged against the heating member, and a pressing member for bringing a recording material as a material to be heated into close contact with the heating member, and in which the heat of the heating member is imparted to the recording material through the film to thereby heat and fix an unfixed image formed and borne on the surface of the recording material.

This apparatus can be widely used not only as a fixing apparatus but also as an apparatus for heating a recording material bearing an image thereon and changing the surface property (such as gloss) thereof, and means heating a member to be heated such as tentatively fixing an image thereon.

The heating apparatus of such a film heating type can use a heating member of low heat capacity quick in temperature rise and thin film and therefore, has advantages that the saving of electric power and the shortening of wait time (quick starting property) becomes possible, and that the temperature rise in the interior of a main apparatus such as an image forming apparatus can be lowered, and Is thus effective.

In an apparatus like the heating apparatus of the heat roller type or the film heating type in which a material to be heated is introduced into the pressure contact nip portion between a heating member and a pressing member and the material to be heated is heated while being pinched and conveyed by the two members, a fluctuation occurs to the pinching and conveyance speed of the material to be heated depending on the temperature state of constituent members. For example, in a heating apparatus of the film heating type and of a pressing member driving type in which a pressing member (hereinafter referred to as the pressing roller) urged against a heating member with film interposed therebetween is rotatively driven, whereby the film or the film and a material to be heated together are pinched and conveyed in the pressure contact nip portion between the heating member and the pressing roller while the film is slidingly moved relative to the heating member, the temperature of the pressing roller rises with the operation of the apparatus, whereby the outer diameter of the pressing roller is increased by the thermal expansion of the rubber portion thereof.

The pressing roller is usually rotatively driven at a constant number of rotations and therefore, when the pressing roller is at a high temperature, the thermal expansion thereof becomes greater and the rotational peripheral speed thereof is increased and the pinching and conveying speed of the material to be heated becomes higher than when the pressing roller is at a low temperature.

That is, depending on the temperature state of the pressing roller, a difference occurs to the pinching and conveying speed of the material to be heated by the heating apparatus.

Therefore, for example, when this heating apparatus is used as an image heating and fixing apparatus in an image forming apparatus, the conveyance of a recording material at an image making portion which is a processing portion upstream of the heating apparatus, for example, an image transfer portion, is kept constant and therefore, when the recording material comes from the image transfer portion to the recording material pressure contact nip portion (fixing portion) of the heating apparatus and assumes its pinched and conveyed state, there is created a state in which the pinching and conveying speed of the recording material at the fixing portion of the heating apparatus is greater than the conveying speed of the recording material at the image transfer portion when the pressing roller is in a high temperature state, and thus the heating apparatus pulls the recording material and under this influence, image blur occurs in the image transfer portion.

When in expectation of this recording material pulling phenomenon, the pinching and conveying speed of the recording material by the heating apparatus is initially set to a level lower than the conveying speed of the recording material at the image transfer portion, an unnecessary loop (looseness) is formed in the recording material at the recording material conveying portion between the image transfer portion and the fixing portion of the heating apparatus at a point of time whereat the temperature of the pressing roller is still low, and the direction of separation of the recording material from an image bearing member after the image transfer at the image transfer portion and the angle of entrance of the recording material into the fixing portion of the heating apparatus become unstable and therefore, the image scattering during the separation of the recording material from the image bearing member and the offset or the like at the fixing portion of the heating apparatus occur. Also, when the recording material used is thick, image blur occurs at the image transfer portion due to the rigidity of the recording material.

To eliminate the evils by the recording material pulling phenomenon due to the fluctuation in the recording material pinching and conveying speed of such a heating apparatus and the unnecessary loop forming phenomenon, it would occur to mind to lengthen the distance of the recording material conveying portion between the image transfer portion and the fixing portion of the heating apparatus and shorten the time for which the recording material is present at the image transfer portion and the fixing portion of the heating apparatus at a time.

However, in an image forming apparatus like an A3 machine using a long recording material, the recording material conveying distance between the image transfer portion and the fixing portion becomes too long, and the main body of the image forming apparatus has become considerably bulky.

Also, Japanese Patent Application Laid-Open No. 7-261584 proposes a method of detecting the amount of loop of a recording material or detecting the conveying speed of the recording material and varying the driving speed of a pressing roller. In this method, however, control cannot be done until the first recording material arrives at a heating apparatus (a fixing device), and when the recording material is to be conveyed at a high speed, control may not be in time.

There is also proposed a method of measuring the temperature of a pressing roller, and foreseeing the amount of expansion thereof and varying the driving speed, but in this method, the error is great and therefore more accurate control cannot be done.

Also, Japanese Patent Application Laid-Open No. 8-190298 proposes a method of providing a plurality of reflecting plates on film, reading the cycle of ON-OFF of a reflection type sensor to thereby detect the peripheral speed of the film, and sequentially varying the driving speed of a pressing roller so that the peripheral speed may become constant.

However, there has been desired a method more improved in the strength of adhesion of the reflecting plates to the film, the reflecting performance of the reflecting plates and the prevention of the staining of the reflecting plates.

SUMMARY OF THE INVENTION

It is an object of the present invention to provide an image heating apparatus which improves the strength of adhesion of a marking portion to a rotary member, the reflecting performance of the marking portion, and the prevention of the staining of the marking portion.

It is another object of the present invention to provide an image heating apparatus which comprises a rotary member contacting with a recording material bearing an image thereon, a marking portion provided on the rotary member, and detecting means for detecting the rotational speed of the rotary member by reflected light from the marking portion, and in which the image on the recording material is heated by heat from the rotary member side, and the marking portion has a mixture of an adhesive agent and a reflective material.

It is still another object of the present invention to provide an image heating apparatus which comprises a rotary member contacting with a recording material bearing an image thereon, a marking portion provided on the rotary member, and detecting means for detecting the rotational speed of the rotary member by reflected light from the marking portion, and in which the image on the recording material is heated by heat from the rotary member side, and the marking portion has a spherical reflecting member.

It is yet still another object of the present invention to provide an image heating apparatus which comprises a rotary member contacting with a recording material bearing an image thereon, a marking portion provided on the rotary member, and detecting means for detecting the rotational speed of the rotary member by reflected light from the marking portion, and in which the image on the recording material is heated by heat from the rotary member side, and the marking portion has a metallic member.

It is a further object of the present invention to provide an image heating apparatus which comprises a rotary member contacting with a recording material bearing an image thereon, a marking portion provided on the rotary member, and detecting means for detecting the rotational speed of the rotary member by reflected light from the marking portion, and in which the image on the recording material is heated by heat from the rotary member side, and the marking portion has a reflecting member, which is directly evaporated on the rotary member.

It is still a further object of the present invention to provide an image heating apparatus which comprises a rotary member contacting with a recording material bearing an image thereon, a marking portion provided on the rotary member, and detecting means for detecting the rotational speed of the rotary member by reflected light from the marking portion, and in which the rotary member has a base layer and a surface parting layer, the image on the recording material is heated by heat from the rotary member side, and the marking portion is a portion on which the surface parting layer is partly not provided and the base layer is exposed.

It is yet still a further object of the present invention to provide an image heating apparatus which comprises a rotary member contacting with a recording material bearing an image thereon, a marking portion provided on the rotary member, and detecting means for detecting the rotational speed of the rotary member by reflected light from the marking portion, and in which the image on the recording material is heated by heat from the rotary member side, the rotary member has a slit, and the marking portion has a reflecting member, which is wound through the slit.

It is another object of the present invention to provide an image heating apparatus which comprises a rotary member contacting with a recording material bearing an image thereon, a marking portion provided on the rotary member, and detecting means for detecting the rotational speed of the rotary member by reflected light from the marking portion, and in which the image on the recording material is heated by heat from the rotary member side, and the marking portion is a hole (aperture) having a reflecting member on the back side thereof.

It is still another object of the present invention to provide an image heating apparatus which comprises a rotary member contacting with a recording material bearing an image thereon, and a marking portion provided on the rotary member to detect the rotational speed of the rotary member, and in which the image on the recording material is heated by heat from the rotary member side, and the marking portion differs in surface resistance, dielectric constant or magnetism from other portions with respect to the circumferential direction of the rotary member.

It is yet still another object of the present invention to provide an image heating apparatus which comprises a rotary member contacting with a recording material bearing an image thereon, a marking portion provided on the rotary member, and detecting means for detecting the rotational speed of the rotary member by reflected light from the marking portion, and in which the image on the recording material is heated by heat from the rotary member side, the rotary member has a base layer, a surface parting layer and a primer layer provided between the base layer and the surface parting layer, and the marking portion has a mixture of the material of the surface parting layer and a reflective material.

Further objects of the present invention will become apparent from the following detailed description.

DESCRIPTION OF THE PREFERRED EMBODIMENTS

Some embodiments of the present invention will hereinafter be described with reference to the drawings.

Figure 1:
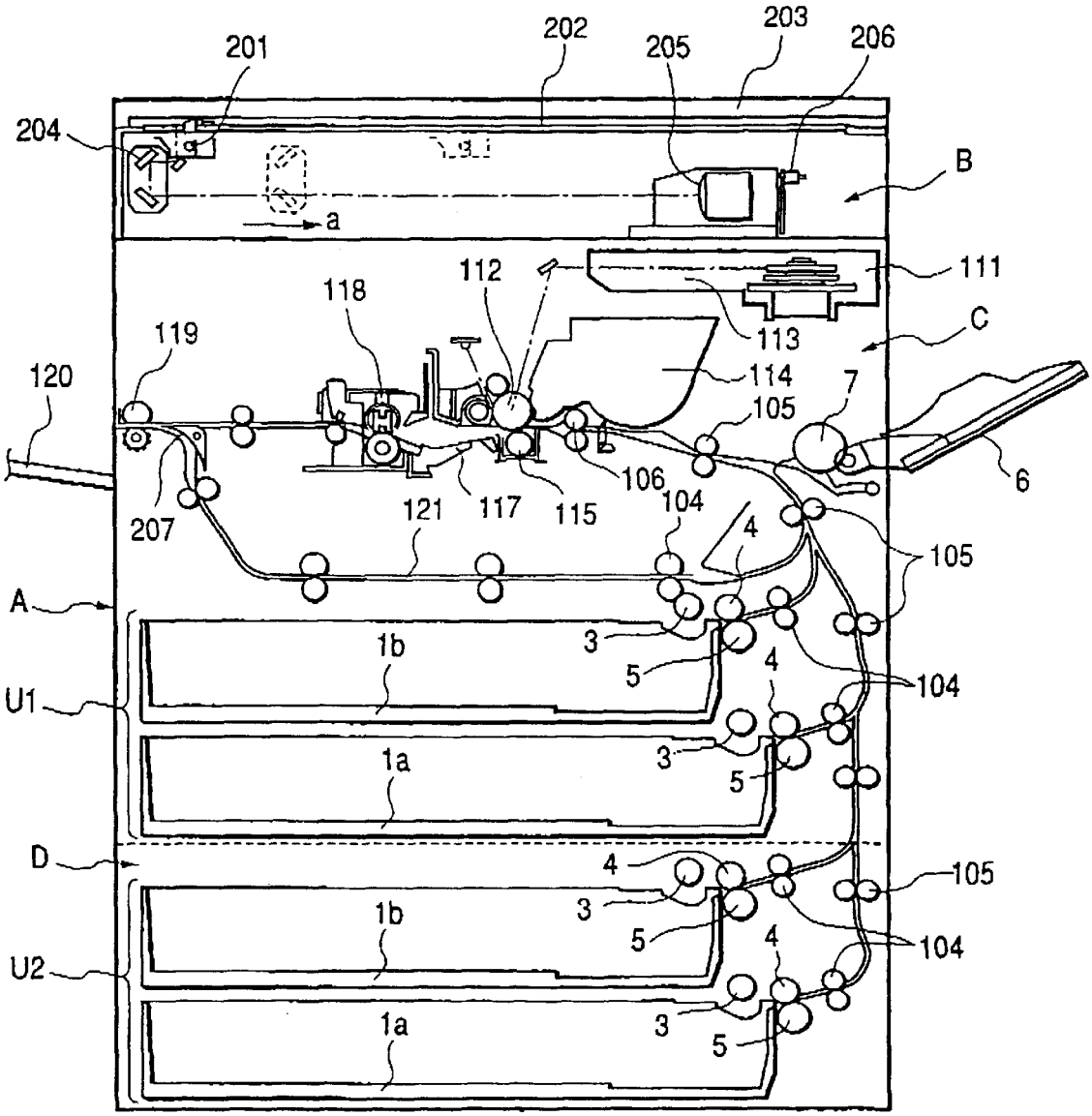
FIG. 1 shows an image forming apparatus to which an image heating apparatus which is an embodiment of the present invention is applied.

FIG. 1 schematically shows the construction of an image forming apparatus in an embodiment of the present invention. The image forming apparatus of the present embodiment is a laser copier utilizing the transfer type electrophotographic process which is provided with an image reading scanner portion.

The main body A of this image forming apparatus has in the upper portion thereof an image reading scanner portion B which is image reading means for reading the image information of an original, and has in the lower portion thereof an image forming portion C which is image forming means (an image marking portion), and has a sheet deck D assembled to the lower portion of the image forming portion C.

The reference numeral 202 designates platen glass horizontally fixedly disposed, and a book original or a sheet-shaped original such as a book, thick paper or a card is placed on the platen glass 202 with the image bearing surface thereof to be read facing downward in accordance with a predetermined placement standard, and is set in a stationary state with the back thereof pressed by an original pressing plate 203.

When a reading start key is depressed, a movable scanning unit including a scanning system light source 201, a scanning system mirror 204, etc. disposed on the underside of the platen glass 202 is forwardly driven in the direction of arrow a which is the rightward direction from the home position indicated by solid line on the left side of the platen glass along the underside of the platen glass.

Thereby, the downwardly facing image bearing surface of the original set on the platen glass 202 is sequentially illuminated and scanned from the left side to the right side, and the reflected light of the illuminating scanning light from the surface of the original enters a light receiving element (photoelectric conversion element) 206 through a lens 205 and is photoelectrically read, is processed by an image processing portion, and is converted into an image information electrical signal, which is transmitted to the laser scanner 111 of the image forming portion C.

The movable scanning unit is moved to a predetermined forward movement end, whereupon it is turned to backward movement and is returned to the home position.

The reference numeral 112 denotes a rotary drum type electrophotographic photosensitive member (hereinafter referred to as the photosensitive drum) as an image bearing member. This photosensitive drum 112 is rotatively driven in a clockwise direction at a predetermined peripheral speed (process speed), and is subjected to a uniform charging process of a predetermined polarity and potential by a charging device in the rotation process thereof, and the uniformly charged surface thereof is subjected to laser beam scanning exposure corresponding to image information from an image writing optical system 113 provided with a laser scanner 111, whereby an electrostatic latent image corresponding to a scanning exposure pattern is formed on the surface of the photosensitive drum 112.

The electrostatic latent image formed on the surface of the photosensitive drum 112 is developed as a toner image by a developing device 114, and at an image transfer portion which is the abutting nip portion between the photosensitive drum 112 and a transfer charging roller 115, the toner image is sequentially transferred to a sheet (transfer material or paper) as a recording material fed from a sheet feeding portion to the image transfer portion at predetermined control timing.

The sheet passed through the image transfer portion and subjected to the transfer of the toner image is sequentially separated from the surface of the photosensitive drum 112, passes through a conveying portion 117, and is conveyed to a fixing apparatus 118, by which the sheet is heated and pressed and is subjected to the fixing process for the unfixed toner image.

After the separation of the sheet, the rotary photosensitive drum 112 is subjected to a removing process for residual adhering contaminants such as transfer residual toner by a cleaning device, and is also subjected to a charge removing process by an eraser lamp or the like and is repetitively used for image making.

The sheet passed through the fixing device 118, in the case of a one-surface print mode, is discharged to and stacked on a sheet discharge tray (or a sorter) 120 disposed outside the machine by discharge rollers 119.

Also, in the case of a both-surface print mode, the sheet on a first surface of which the image has been formed and which has been discharged from the fixing apparatus 118 is nipped between the discharge rollers 119, and the discharge rollers 119 are reversely rotated at a point of time whereat the trailing end of the sheet has passed a branch-off point 207, and the sheet is once placed on a sheet both-surface tray 121, whereafter it is conveyed by conveying rollers 104 and 105, and arrives at registration rollers 106, and is re-fed to the image transfer portion at predetermined control timing, whereby an image is formed on a second surface of the sheet in a manner similar to the at previously described, whereafter the sheet is discharged to and stacked on the sheet discharge tray 120.

The main body A of the image forming apparatus functions as a copier if the processing signal of the image processing portion of the image reading scanner portion B is inputted to the laser scanner 111 as described above, and functions as a printer if the output signal of an outside computer is inputted. It also functions as a facsimile apparatus if it receives a signal from other facsimile apparatus or It transmits the signal of the image processing portion of the image reading scanner portion B.

A sheet cassette is mounted on the lower portion of the image forming portion C, and this sheet cassette is constituted as a feeding unit by a lower cassette 1*a* and an upper cassette 1*b*. In the present embodiment, two feeding units U1 and U2 are mounted so as to mount four cassettes. The upper feeding unit U1 is detachably mounted to the main body A of the apparatus, and the lower feeding unit U2 is detachably mounted to the sheet deck D. From a selectively designated cassette, sheets contained therein are automatically fed one by one.

That is, the sheets contained in the cassettes 1*a* and 1*b* are paid away by a pickup roller 3 which is a feeding rotary member, and are separated and fed one by one by the cooperative action of a feed roller 4 and a retard roller 5, whereafter the sheet is conveyed by conveying rollers 104 and 105, and is directed to the registration rollers 106, by which the sheet is fed to the image transfer portion of the image forming portion C in such a manner to be synchronized with the image forming operation.

Also, discretely from the sheet cassette, a manual feed tray 6 is disposed on a side of the main body A of the apparatus, and sheets on this tray 6 are paid away toward the registration rollers 106 by a manual feed roller 7.

Figure 2:
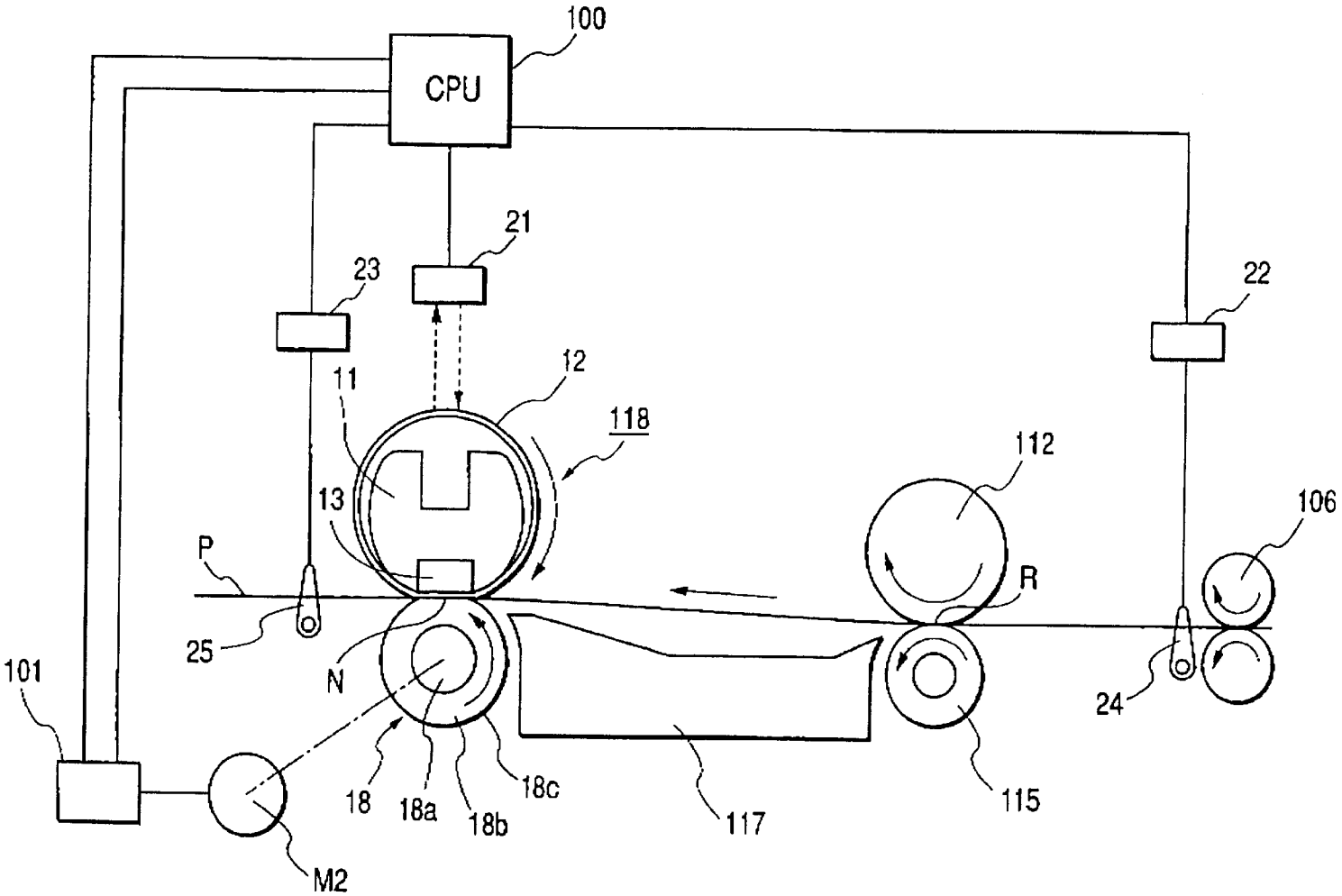
FIG. 2 shows a fixing apparatus and its surroundings.

FIG. 2 is a construction model view of the fixing apparatus 118 and its surrounding portion and a block diagram of a control system.

The fixing apparatus 118 in the present embodiment is a pressing member driving type and tensionless type image heating apparatus of the film heating form.

The reference numeral 11 designates a stay made of heat-resisting resin of which the lengthwise direction is a direction perpendicular to the plane of the drawing sheet.

The reference numeral 13 denotes a low heat capacity heating member such as a ceramic heater disposed and held on the under side of the stay 11 along the length of the stay. The ceramic heater 13 is a generally low heat capacity member basically comprising a thin plate-like ceramic substrate, and a resistance heat generating member formed and provided on the surface of the substrate along the length thereof, and it quickly generates heat and rises in temperature by the supply of electric power to the resistance heat generating member, and is temperature-controlled to a predetermined fixing temperature by a temperature control system.

The reference numeral 12 designates cylindrical (endless belt-shaped) heat-resisting film (fixing-film fitted on the stay 11 including the heater 13. As regards the inner peripheral length of the fixing film 12 and the outer peripheral length of the stay 11 including the heater 13, the former is greater e.g. by the order of 3 mm and accordingly, the fixing film 12 is loosely fitted on the stay 11 including the heater with a surplus of peripheral length.

The film thickness of the fixing film 12 which is a rotary member is of the order of 40 to 100 $\mu$m in total in order to make the heat capacity thereof small and improve the quick starting property, and comprises polyimide film (base layer) having heat-resisting property, strength, durability, etc., and a coat layer (parting layer) provided on the outer peripheral surface of the base layer and consisting of an electrically conducting agent added to fluorine resin such as PTFE or PFA having a parting property.

The reference numeral 18 denotes a pressing roller as a driving rotary member forming a fixing portion N which is a pressure contact nip portion with the fixing film 12 interposed between it and the heater 13, and driving the fixing film 12, and it comprises a core shaft 18*a* of aluminum, iron, stainless steel or the like, and a roller portion (elastic layer) 18*b* having a thickness of 3 mm and an outer diameter of 20 mm and fitted on this shaft and formed of a heat-resisting rubber elastic material having a good parting property such as silicone rubber. Also, on the surface of the pressing roller 18, there is provided a coat layer (parting layer) 18*c* having fluorine resin dispersed therein for the reason of the conveying property of the sheet P as the recording material an the fixing film 12, the prevention of the staining of the toner, etc.

The pressing roller 18 is rotatively driven in the counterclockwise direction of arrow by the end portion of the core shaft 18*a* being driven by a fixing apparatus driving motor M2. By the frictional force between the pressing roller 18 and the outer surface of the fixing film 12 at the fixing portion N by the rotative driving of the pressing roller 18, a rotational force acts on the fixing film 12, and the fixing film 12 is rotatively driven in the clockwise direction of arrow around the stay 11 which the inner surface thereof is in close contact with and slides relative to the underside of the heater 13 at the fixing portion N (pressing member driving type). In this case, in order to reduce the sliding resistance between the inner surface of the fixing film 12 and the underside of the heater with which it contacts and slides, a lubricant such as heat-resisting grease may preferably be interposed between the two.

The stay 11 adiabatically holds the heater 13 and also provides a fixing film inner surface guide member.

Thus, in a state in which the fixing film 12 is rotated by the rotation of the pressing roller 18 and the heater 13 is raised and temperature-controlled to a predetermined fixing temperature, the sheet P as the recording material on which an unfixed toner image is formed and borne is conveyed and introduced from the image transfer portion R side to between the rotary fixing film 12 and the rotary pressing roller 18 of the fixing portion N, and is nipped and conveyed through the fixing portion N together with the fixing film 12, whereby the heat of the heater 13 is imparted to the sheet P through the fixing film 12 and the unfixed toner image is heated and fixed on the surface of the sheet P. The sheet P passed through the fixing portion N is curvature-separated from the surface of the fixing film 12 and is conveyed.

Figure 3:
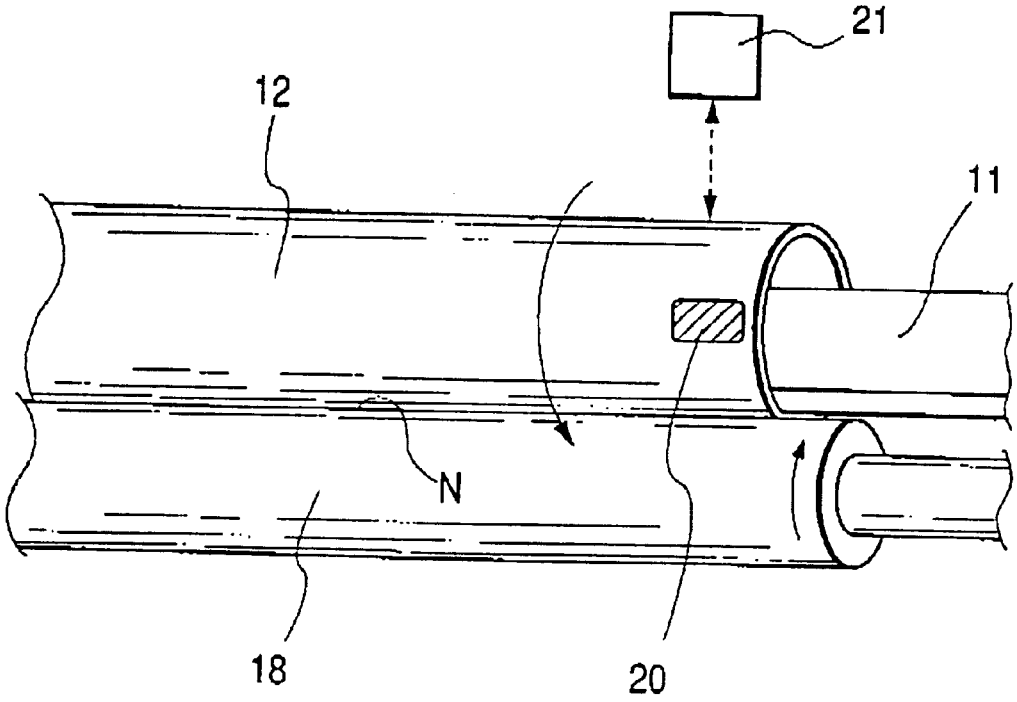
FIG. 3 shows the end portion of film on which a marking is provided.

FIG. 3 is a perspective view of one end portion side of the pressing roller 18 and fixing film 12 of the fixing apparatus 118 as it is seen from the upstream side with respect to the direction of conveyance of the sheet.

The reference numeral 20 denotes a light reflecting material (reflecting plate) as a marking portion formed and provided on the outer surface of the fixing film 12. This light reflecting material 20 is formed and provided by coating a portion of the outer surface of one end portion of the fixing film 12 and outside a sheet passing area.

The reference numeral 21 designates a reflection type sensor which is detecting means having a light emitting element and a light receiving element, and mounted above the rotation track position of the light reflecting material 20 on the end portion side of the fixing film on which the light reflecting material 20 is formed and provided.

The light reflecting material 20 of the fixing film 12 rotates with the rotation of the fixing film 12 and passes under the reflection type sensor 21 once per one full rotation of the fixing film 12. The reflection type sensor 21 detects the reflected light from the reflecting material 20 at each passing time of the light reflecting material 20, and sends the signal thereof to a CPU 100 (see FIG. 2).

The CPU 100 can calculate the time required for the fixing film to make a round from the detection signal and the peripheral length of the fixing film 12, and deduce the rotational speed thereof.

Figure 4:
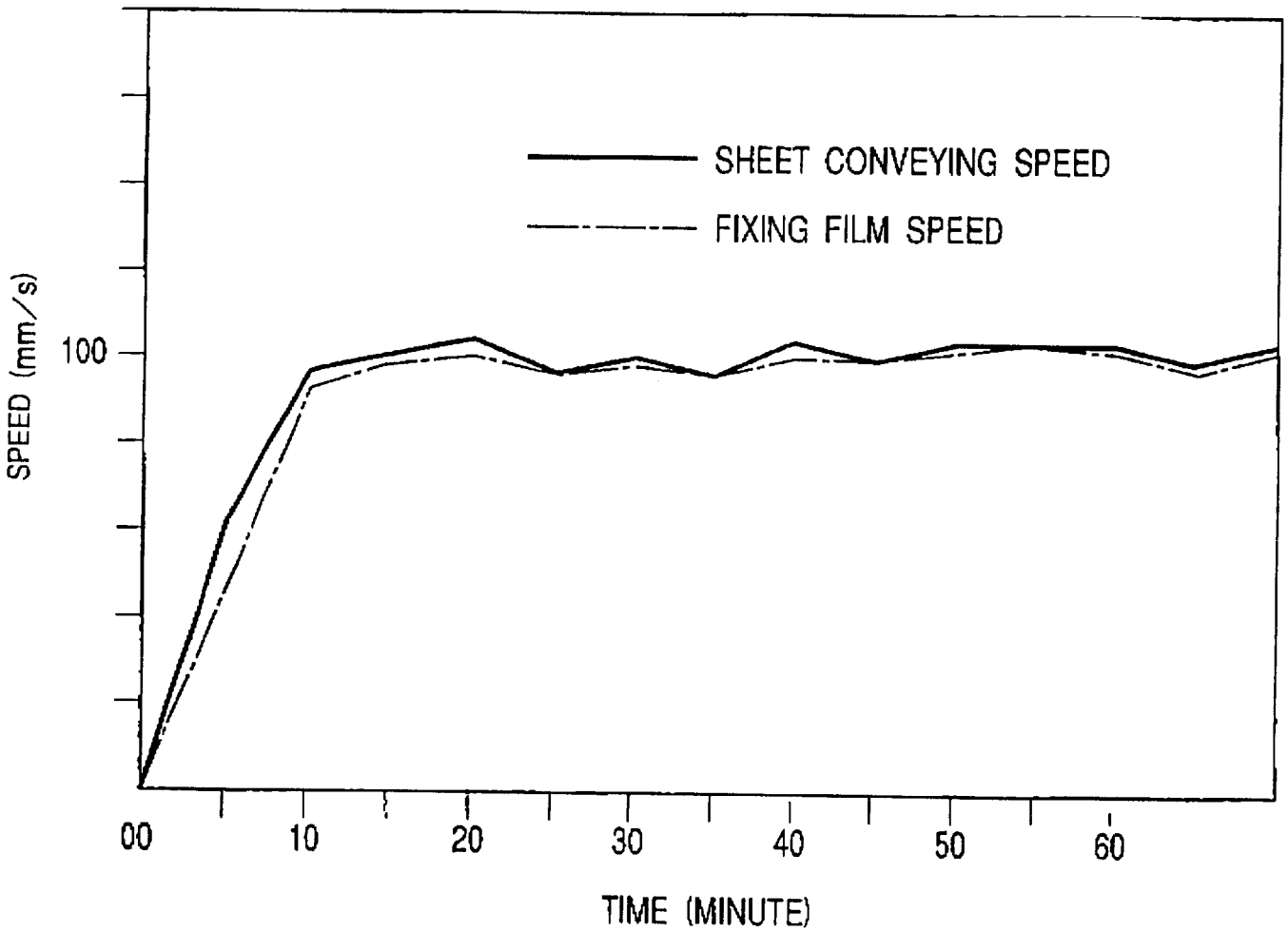
FIG. 4 is a graph showing the relation between sheet speed and film speed.

FIG. 4 is a graph representing variations in the conveying speed of the sheet P as the recording material and the rotational speed of the fixing film 12. According to the inventor's experiment, as shown in FIG. 4, there is a correlation between the conveying speed of the sheet P and the rotational speed of the fixing film 12. Therefore, the actual conveying speed of the sheet P can be foreseen from the rotational speed of the fixing film 12.

So, the CPU 100 controls so as to decrease the speed of the fixing apparatus driving motor M2 by a motor driver 101 when the rotational speed of the fixing film 12 deduced by the input information from the reflection type sensor 21 is higher than a predetermined speed, and controls so as to increase the speed of the fixing apparatus driving motor M2 by the motor driver 101 when the rotational speed of the fixing film 12 deduced by the input information from the reflection type sensor 21 is lower than the predetermined speed.

Figure 5:
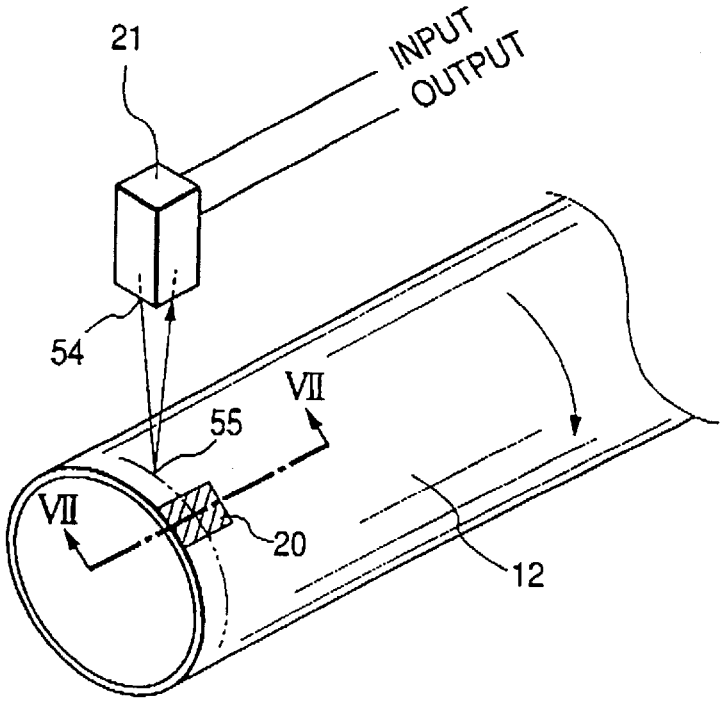
FIG. 5 shows a marking portion and a reflection type detecting sensor.

FIG. 5 is a perspective view showing the positional relation between a reflected light detecting type sensor 21 used as a detecting sensor and the light reflecting material 20 provided as a marking portion on the fixing film 12 and higher in reflectance than the film around it.

When the film 12 is rotated and the light reflecting material 20 arrives at the detection point 55 of the reflected light detecting type sensor 21, the reflectance of the sensor 21 for a light beam 54 rises and the light reflecting material 20, i.e., the marking portion, is detected.

Description will now be made of the detailed constructions of various kinds of marking and methods of manufacturing the same. All of marking portions 20 of the various forms of the following items (1) to (7) are of a marking type which effects detection by the use of the reflection type sensor 21 as shown in FIG. 5. FIGS. 7A, 7B, 7C and 7D are enlarged cross-sectional model views of the marking portion 20 on the film 12 of FIG. 5 taken along line VII—VII.

(1) FIG. 7A

In this example of the marking portion 20, a reflecting member 60 higher in reflectance than the fixing film 12 is adhesively secured and a top coat 61 is provided thereon. The reflecting member 60 comprises high reflectance powder which is a reflective material, e.g. titanium dioxide powder or calcium artificial pearl powder or the like combined or mixed with a liquid silicone or epoxy adhesive agent at a predetermined percentage, and the fixing film subjected to ground processing such as primer processing or blast processing and moreover having had a predetermined thickness applied thereto and dried and hardened.

The top coat 61 is a surface parting layer comprising a transparent paint having fluorine resin combined therewith applied thereto and dried and hardened. The top coat 61 is of structure which is good in light transmitting property and does not reduce reflectance and moreover is small in the angle of contact of the surface and therefore, is effective for a countermeasure for extraneous stairs such as toner and paper powder and improvement in abrasion durability.

(2) FIG. 7B

In this example of the marking portion 20, spherical reflecting member 63 higher in reflectance than the fixing film 12 are adhesively secured by an adhesively securing layer 62, and a top coat 61 is provided thereon.

The spherical reflecting members 63 are spherical particles of a diameter D of lead, glass or the like, and formed into a layer in a row on an adhesively securing layer 62 having a thickness t controlled to ½ D<t<D, and adhesively secured and dried, and finally a top coat 61 is provided thereon.

The adhesive agent is of a liquid silicone origin (series) or an epoxy origin, and the fixing film is subjected to ground processing such as primer processing or blast processing.

The top coat 61 comprises a transparent paint having fluorine resin combined therewith applied and dried and hardened. The effect thereof is the same as that in the case of item (1).

(3) FIG. 7C

In this example of the marking portion 20, a film-like reflecting member 66 higher in reflectance than the fixing film 12 is adhesively secured by an adhesively securing layer 65, and a top coat 61 is provided thereon as required.

The film-like reflecting member 66 is adhesively secured onto the adhesively securing layer 65 by metallic foil such as aluminum.

The adhesive agent is liquid silicone or epoxy series, and the fixing film is subjected to ground processing such as primer processing or blast processing.

(4) FIG. 7D

In this example of the marking portion 20, a film-like metallic reflecting member 67 higher in reflectance than the fixing film 12 is directly deposited by evaporation on the ground-processed surface of the fixing film, and in this case, the adhesively securing layer is absent.

Figure 8A:
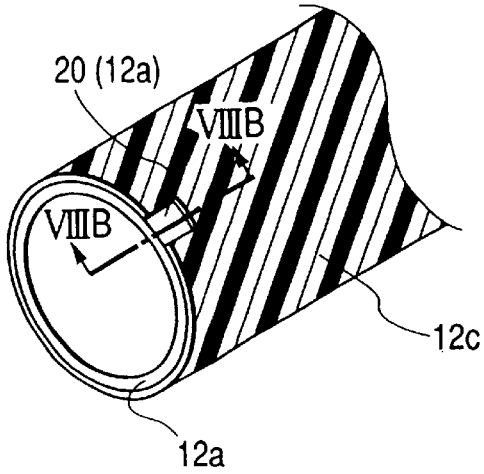
FIGS. 8A and 8B show a marking portion.
Figure 8B:
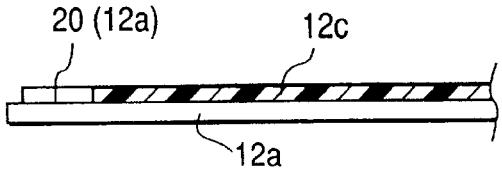

(5) FIGS. 8A and 8B

In this example of the marking portion 20, a coat layer 12*c* consisting of an electrically conducting agent added to fluorine resin such as PTFE or PFA is partly masked and formed on the outer peripheral surface of a fixing film base layer 12*a* of polyimide, and the portion which is masked and free of the coat layer 12*c* and in which a fixing film. portion 12*a* of polyimide is exposed is the marking portion 20. The difference in reflectance between the fixing film portion 12*a* of polyimide as the marking portion 20 and the coat layer 12*c* Is detected by the sensor 21.

Figure 9A:
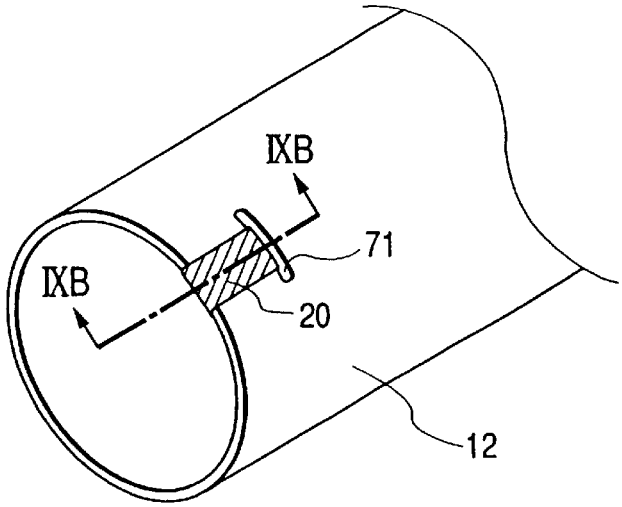
FIGS. 9A and 9B show a marking portion.
Figure 9B:
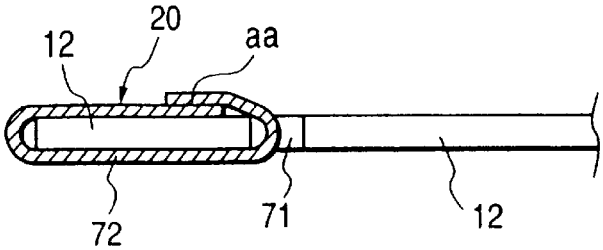
Figure 10:
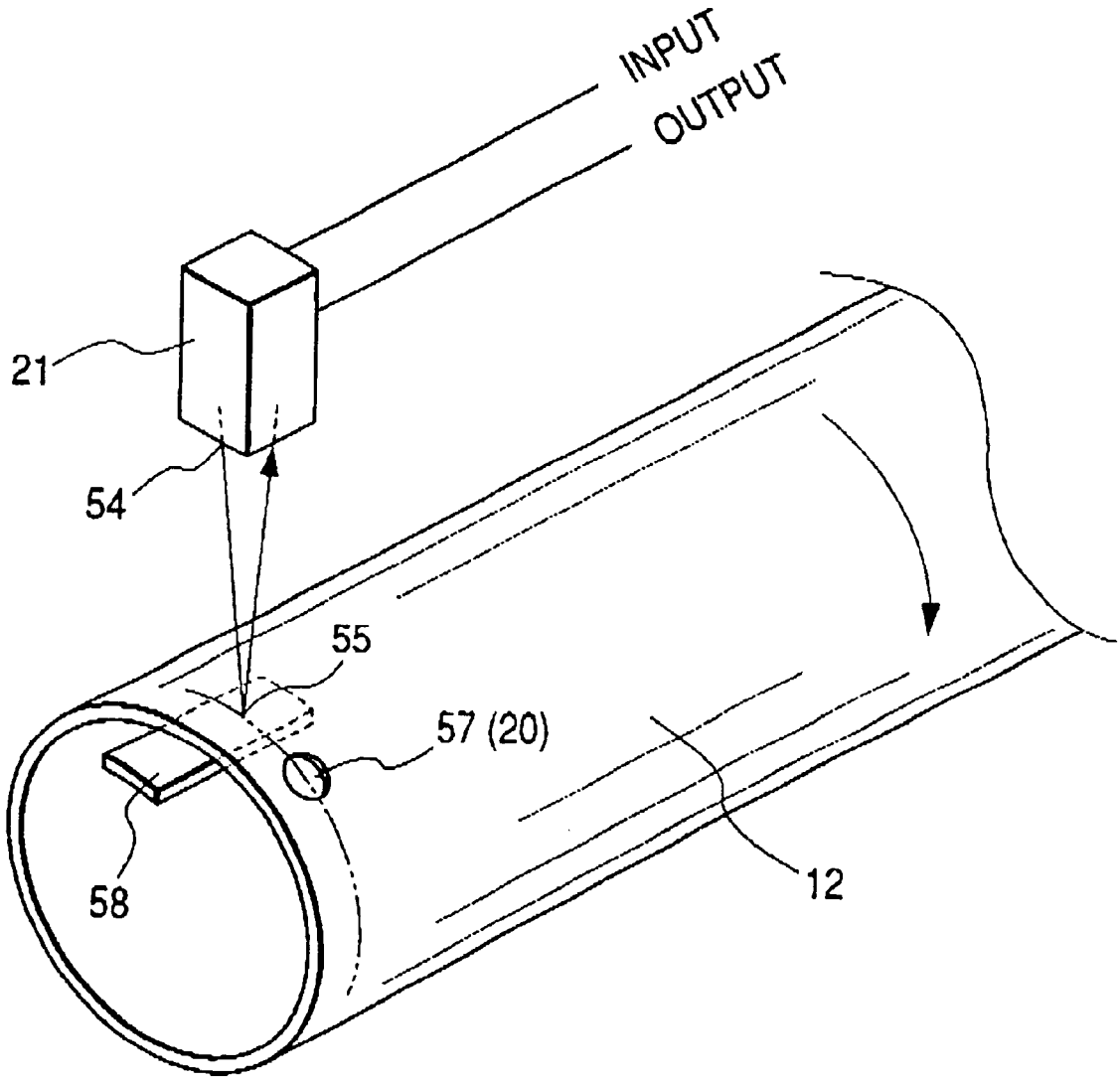
FIG. 10 shows a marking portion.
Figure 11B:
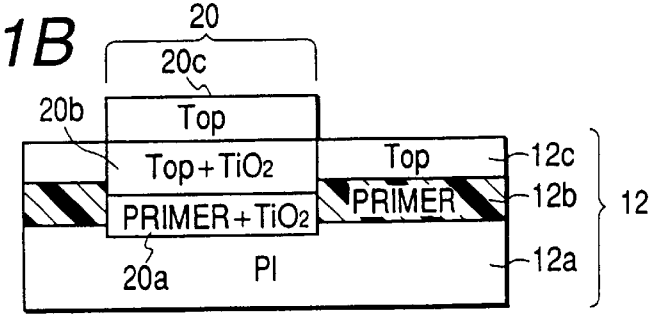
FIGS. 11A, 11B, 11C, 11D, 11E and 11F show marking portions.
Figure 11A:
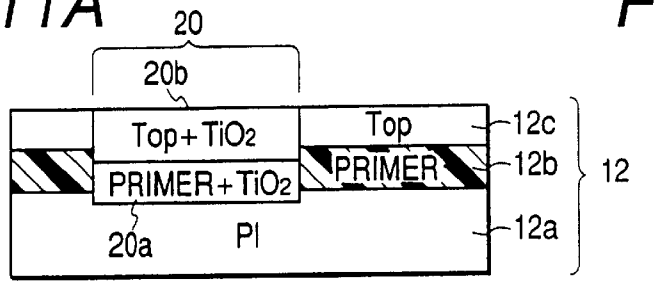
Figure 11D:
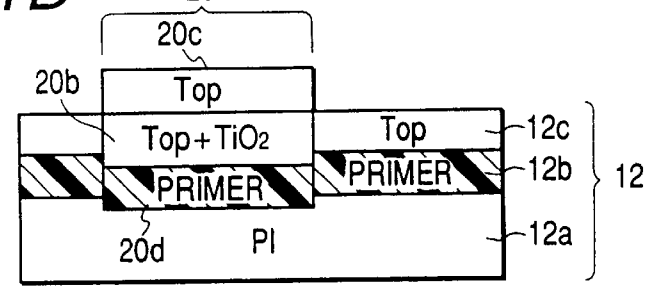
Figure 11C:
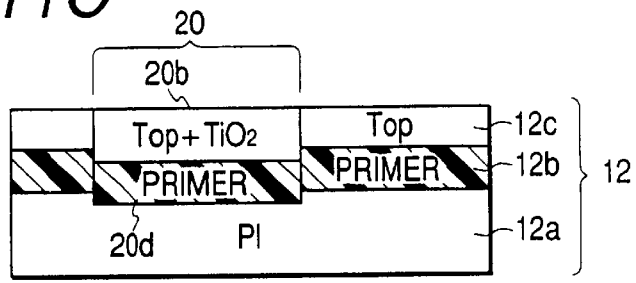
Figure 11F:
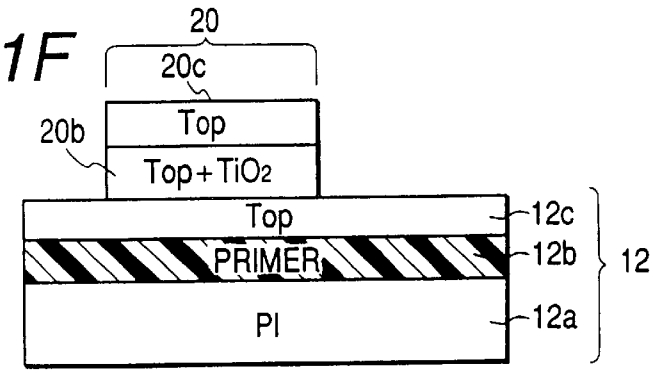
Figure 11E:
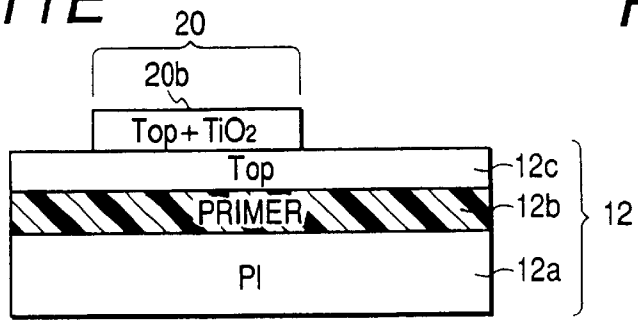

(6) FIGS. 9A and 9B

In this example of the marking portion 20, a slit 71 is provided in a portion of the fixing film 12, and a marking member 72 such as metallic film is passed through the slit 71 and wound into a band-shape, and the end portion aa thereof is adhesively secured to the metallic film, and this portion of the member 72 is provided as the marking portion 20.

(7) FIG. 10

In this example of the marking portion 20, an aperture (hole) 57 is formed in the end portion of the fixing film 12, a reflecting plate 58 differing in reflectance from the fixing film 12 is provided on the opposed surface of the sensor 21, and the difference in reflectance from the fixing film 12 when the aperture 57 passes the location of the reflecting plate 58 is detected by the sensor 21.

The other detailed constructions and manufacturing methods of the respective kinds of markings will now be described with reference to FIGS. 11A to 11F. Any of the marking portions 20 in the forms of the following items (8) to (13) is of a marking type which effects detection by the use of the reflection type sensor 21 as shown in FIG. 5. FIGS. 11A to 11F are enlarged cross-sectional model views of the marking portion 20 on the film 12 of FIG. 5 taken along line VII—VII.

(8) FIG. 11A

This example of the fixing film 12 is of three-layer structure in which a primer layer 12*b* consisting of fluorine resin mixed with polyimide is superposed on a base layer 12*a* of polyimide (PI) or the like and further, a top coat layer 12*c* having fluorine resin distributed therein and applied as a coating is provided and sintered.

The marking portion 20 is of a construction in which during the sintering of the fixing film 12, the surface of the base layer 12*a* of the film is masked, whereafter high reflectance powder which is a reflective material higher in reflectance than the surface of the film top coat layer, for example, titanium dioxide powder, calcium artificial pearl powder or the like is combined and mixed with a primer material constituting the film primer layer 12*b* and a top coat material constituting the film top coat layer 12*c* at a predetermined proportion, and they are successively applied and re-sintered as a marking portion primer layer 20*a* and a marking portion top coat layer 20*b*.

The surface of this marking portion 20 is higher in reflectance than the surrounding top coat layer 12*c* and has fluorine resin of a good parting property distributed therein and therefore, it is difficult for the toner or the like to adhere thereto and the reflectance thereof is not reduced.

(9) FIG. 11B

This example is such that in the fixing film 12 of item (8) above, the same protective top coat layer 20*c* as the surrounding film top coat layer 12*c* which does not include high reflectance powder is further provided on the upper surface of the marking portion 20.

The construction of this marking portion 20 is somewhat reduced in reflectance as compared with the marking portion 20 of the fixing film 12 of item (8) above, but is further effective for the prevention of the staining of the marking portion 20.

(10) FIG. 11C

This example is such that the marking portion primer layer 20*a* in the fixing film 12 of item (8) above is changed to the same primer layer 20*d* as the surrounding film primer layer 12*b* which does not include high reflectance powder.

The construction of this marking portion 20 is thin in the reflecting layer and is somewhat reduced in reflectance, but further increases in the isolation strength of the marking portion top coat layer 20*b* and increases in durability.

(11) FIG. 11D

This example is such that in the fixing film 12 of item (10) above, the same protective top coat layer 20*c* as the surrounding film top coat layer 12*c* which does not include high reflectance powder is further provided on the upper surface of the marking portion 20.

The construction of this marking portion 20 is somewhat reduced in reflectance as compared with the marking portion 20 of the fixing film 12 of item (10) above, but is further effective for the prevention of the staining of the marking portion 20.

(12) FIG. 11E

This example of the fixing film 12 is of three-layer structure in which a primer layer 12*b* consisting of fluorine resin mixed with polyimide is superposed on a base layer 12*a* of polyimide (PI) or the like, and a top coat layer 12*c* having fluorine resin distributed therein and applied as a coating is provided and sintered.

The marking portion 20 has the same film top coat layer 12*c* as the surroundings which is free of masking, and a layer 20*b* consisting of high reflectance powder higher in reflectance than the surface of the film top coat layer, for example, titanium dioxide, powder calcium artificial pearl powder or the like, combined with and applied to a top coat material constituting the film top coat layer 12*c* and re-sintered is further constructed on the film top coat layer 12*c*.

In this technique, masking becomes unnecessary and therefore, the manufacturing process can be simplified.

The marking portion 20 comprising this layer 20*b* has distributed therein fluorine resin higher in reflectance than the surrounding film top coat layer 12*c* and having a good parting property and therefore is not reduced in reflectance even if the toner or the like adheres to the surface thereof.

(13) FIG. 11F

This example is such that in the fixing film 12 of item (12) above, the same top coat layer 20*c* as the surrounding film top coat layer 12*c* which does not include high reflectance powder is further provided on the upper surface of the marking portion 20.

The construction of this marking portion 20 is somewhat reduced in reflectance as compared with the marking portion 20 of the fixing film 12 of item (12) above, but is further effective for the prevention of the staining of the marking portion 20.

As described above, according to the marking portion according to the above-described embodiment of the present invention, the strength of the adhesion of the marking portion to the film, the reflecting performance of the marking portion and the prevention of the staining of the marking portion can be improved.

Figure 6:
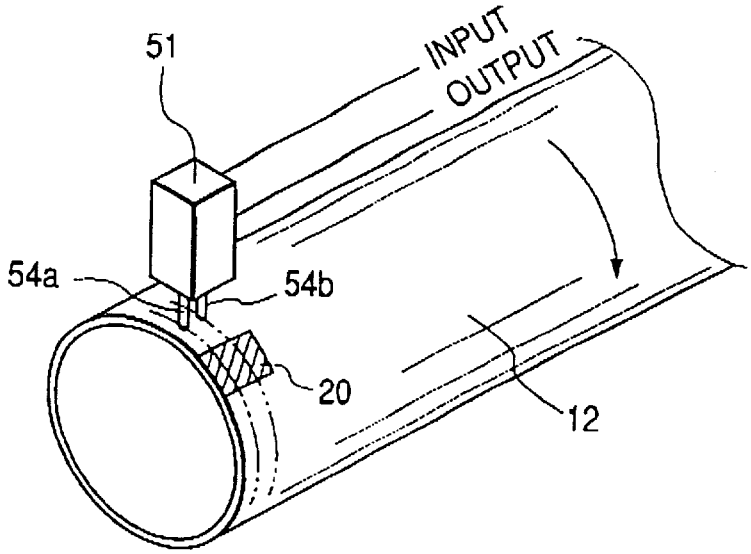
FIG. 6 shows the marking portion and a contact type detecting sensor.
Figure 7A:
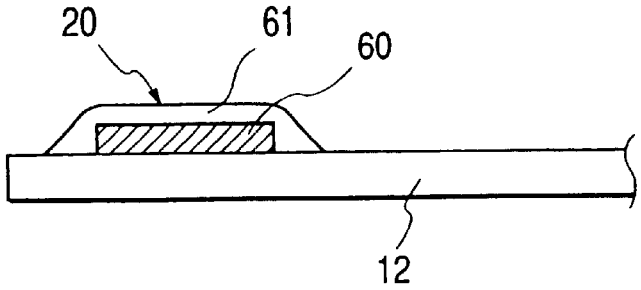
FIGS. 7A, 7B, 7C and 7D are cross-sectional views of marking portions.
Figure 7B:
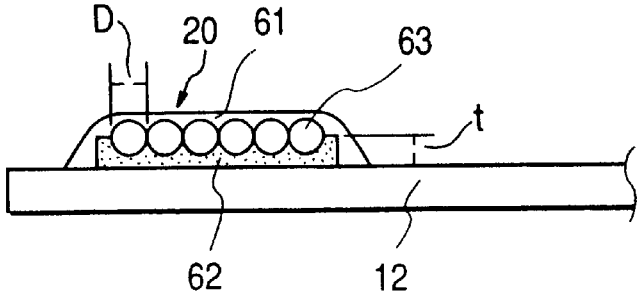
Figure 7C:
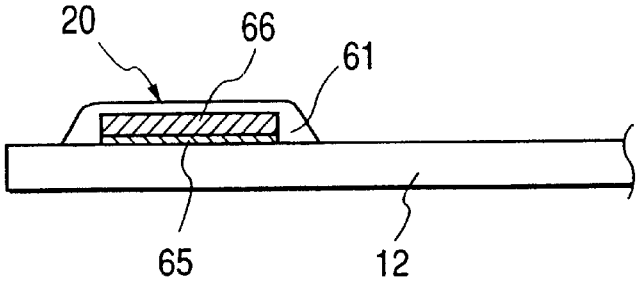
Figure 7D:
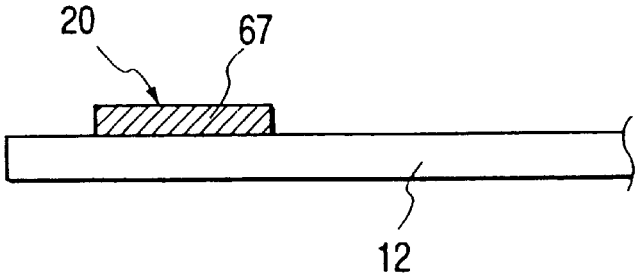

FIG. 6 shows an example in which a sensor 51 for contact type resistance detection, dielectric constant detection or magnetism detection is used as the detecting sensor, and the marking portion 20 on the fixing film 12 has applied thereto, deposited by evaporation thereon, welded thereto or adhesively secured thereto a material (a metal or the like) differing in surface resistance value, dielectric constant or magnetism from the surrounding film surface.

The detecting elements 54*a* and 54*b* of the sensor 51 are normally in contact with the film 12, and are designed to read the difference in surface resistance value, dielectric constant or magnetism between the marking portion 20 and the film portion free of the marking portion.

Referring to FIG. 2, the reference numeral 24 designates a first paper detecting sensor (sheet detecting sensor) disposed on the sheet exit side of the registration rollers 106. The reference numeral 25 denotes a second paper detecting sensor disposed on the sheet exit side of the fixing portion N. The first and second paper detecting sensors 24 and 25 are provided with flag portions, not shown, and can detect the arrival and passage of the sheet P by photointerrupters 22 and 23. The detection signals are inputted to the CPU 100.

Figure 12:
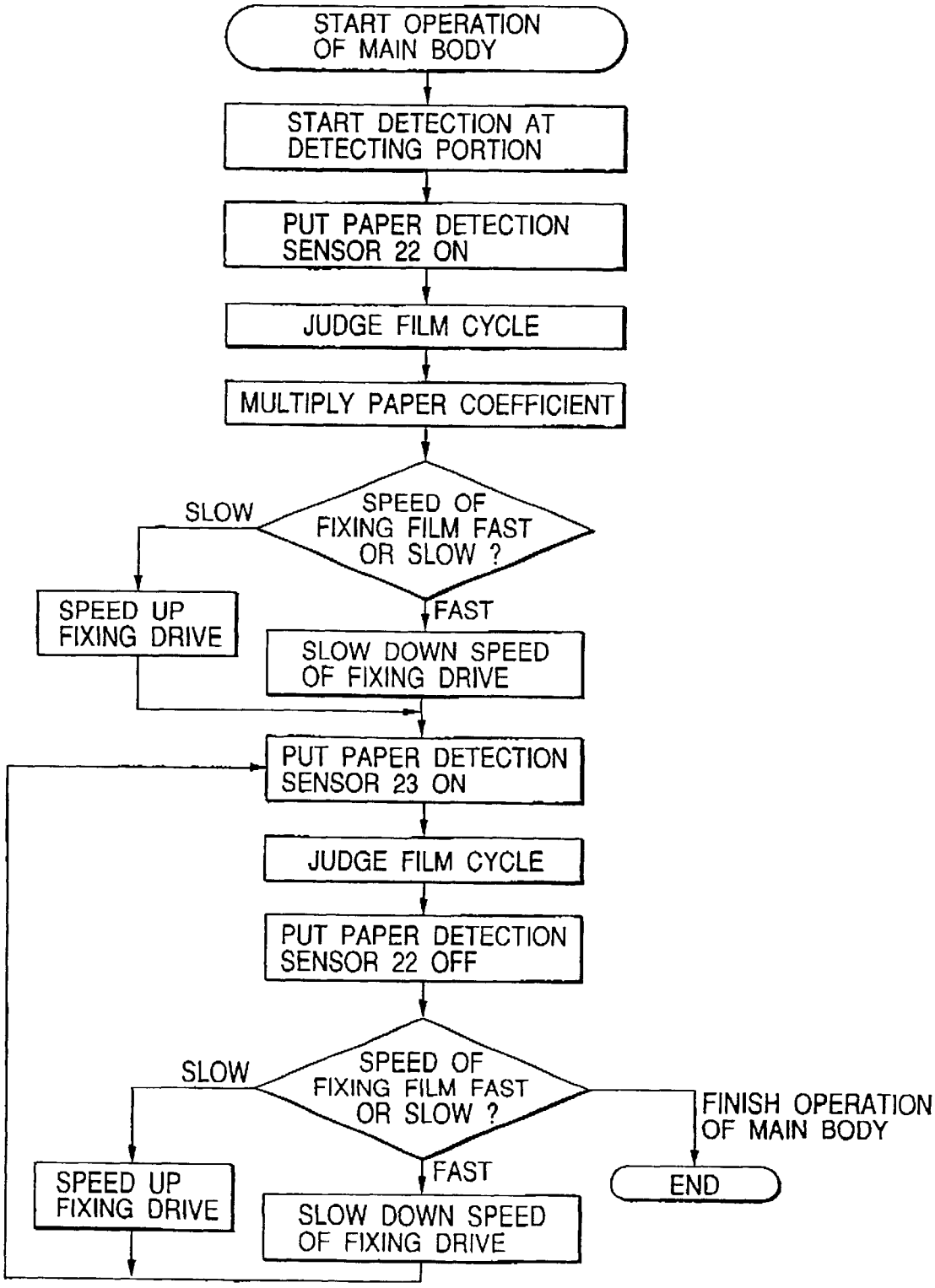
FIG. 12 is a flow chart showing film speed detection.

FIG. 12 is a flow chart representing specific control.

When the power source switch of the main body of the image forming apparatus is closed, the rotative driving of the pressing roller 18 of the fixing apparatus 118 is started, and electric power is supplied to the heater 13 and the fixing portion N is controlled so as to assume a predetermined temperature.

In the meantime, the pressing roller 18 also rises in temperature and therefore begins its thermal expansion. Therefore, the rotational peripheral speed of the pressing roller 18 increases and at the same time, the rotational speed of the fixing film 12 also increases as shown in FIG. 4. However, it is of course low relative to a desired speed.

The reflection type sensor 21 always detects the fixing film cycle (rotation cycle).

When the sheet P arrives at the first paper detecting sensor 24, the photointerrupter 22 becomes ON. At this point of time, the CPU 100 picks up the latest data D1 of the fixing film cycle.

It compares the data D1 with a target fixing film cycle T and increases or decreases the fixing driving speed, but in the case of the first sheet, the following need be taken into consideration.

Figure 13:
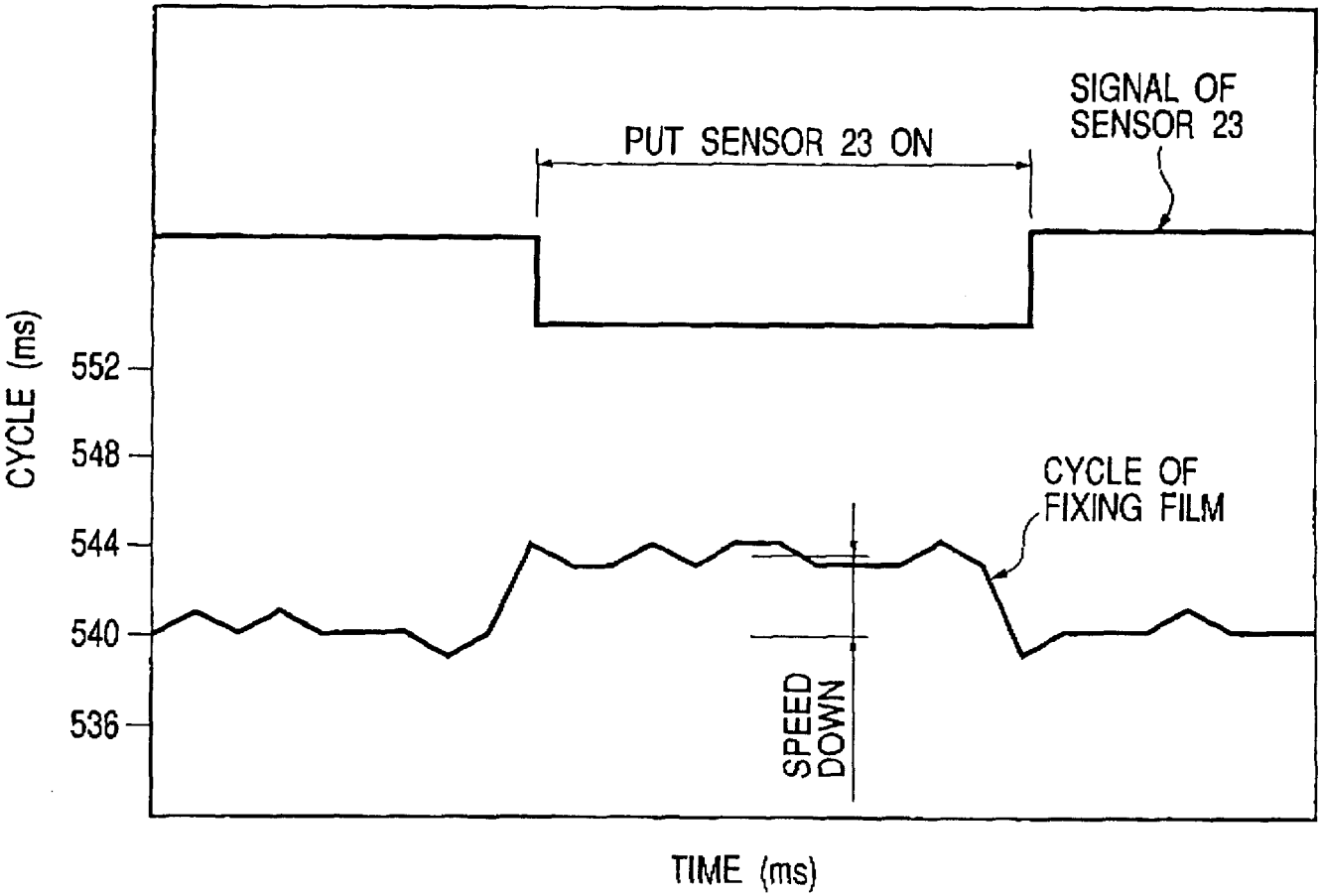
FIG. 13 shows the film speed when a sheet is present at the nip.

FIG. 13 is a graph representing the variations in the fixing film cycle while a sheet P passes through the image forming apparatus when the speed is not controlled. From this graph, it will be seen that the fixing film cycle becomes long while the sheet P is at the fixing portion N. It is known from an experiment that the percentage thereof is about 0.8%.

That is, when the fixing driving speed is set on the basis of the aforementioned data D1 of the fixing film cycle, the fixing film speed actually becomes lower, that is, the speed of the sheet also becomes lower, and the disturbance of the image occurs.

So, comparison is made with the target fixing film cycle T by the use of fixing film cycle data D1*a* obtained by multiplying the fixing film cycle data D1 by a paper coefficient A for correcting an increment in the fixing film cycle resulting from the passage of the sheet.

D1*a*=A*D1 (A: paper coefficient; in the present embodiment, A=1.008)

The fixing driving speed is immediately increased or decreased, whereby when the first sheet arrives at the fixing apparatus 118, the rotational speed of the fixing film 12 can be maintained at a desired speed and therefore, the conveying speed of the sheet P likewise becomes a desired speed. Consequently, a good image can be obtained.

When the first sheet P arrives at the paper detecting sensor 25, the photointerrupter 23 becomes ON. At this point of time, the CPU 100 picks up the latest data D2 of the fixing film cycle.

In this case, the sheet P is at the fixing portion N and therefore, it is not necessary to multiply the data D2 of the fixing film cycle by the paper coefficient A as in the case of the first sheet, and the data D2 of the fixing film cycle can be compared with the target fixing film cycle T.

Here, when it has become necessary to vary the speed of the motor M2, if the speed of the motor M2 is immediately varied at this point of time, an inconvenience occurs. That is, it is often the case that the trailing end of the sheet P is still present at the image transfer portion R, and if at this time, the speed of the sheet P in the fixing apparatus 118 is suddenly varied, vibration caused thereby may be transmitted through the sheet to thereby cause blur to the image.

So, here, design is made such that the speed of the motor is not immediately varied, but is varied to a desired speed E seconds after the paper detecting sensor 24 has become OFF. E seconds is set to a time sufficient for the trailing end of the sheet to leave the image transfer portion R after it has left the paper detecting sensor 24. That is, the speed of the motor M2 is varied after the sheet has completely left the image transfer portion R.

Next, the second sheet is conveyed at a motor speed set here. When the leading end of the second sheet arrives at the paper detecting sensor 25, the photointerrupter 23 becomes ON. At this point of time, the CPU 100 picks up the latest data D3 of the fixing film cycle.

Then, the data D3 of the fixing film cycle is compared with the target fixing film cycle T, the next motor speed is determined and the motor M2 is varied at timing similar to that previously described.

Thereafter, it can be repeated.

As described above, in the present embodiment, when the speed of the fixing film 12 is detected to thereby foresee the conveying speed of the sheet P as a material to be heated and control the driving speed of the pressing roller 18, the pressing roller is controlled by detecting the time required for the fixing film to make a round and therefore, the marking portion 20 such as a light reflecting material provided on the fixing film 12 may be only one and thus, the fixing film can be manufactured at a low cost. Also, the accuracy between marking portions is unnecessary and therefore, manufacture is easy. Also, the signal can be processed once for each sheet and therefore, an inexpensive CPU is sufficient.

Also, in the case of the first sheet, the fixing film speed is judged with the fixing film speed when no sheet is present at the fixing portion N being also multiplied by the paper coefficient and therefore, before the sheet arrives at the fixing apparatus 118, the sheet conveying speed can be controlled and stable images can always be obtained. A higher speed can also be coped with.

Also, the heating apparatus of the present invention is not restricted to the image heating and fixing apparatus of the above-described embodiment, but can of course be widely used, for example, as an apparatus for heating a recording material bearing an image thereon and improving the surface property (gloss or the like) thereof, an apparatus for carrying out a tentative fixing process, and a heating apparatus for feeding a sheet-shaped article and drying and laminate-processing it.

Also, the film may be wound and extended with tension imparted to between the extending members.

Figure 14:
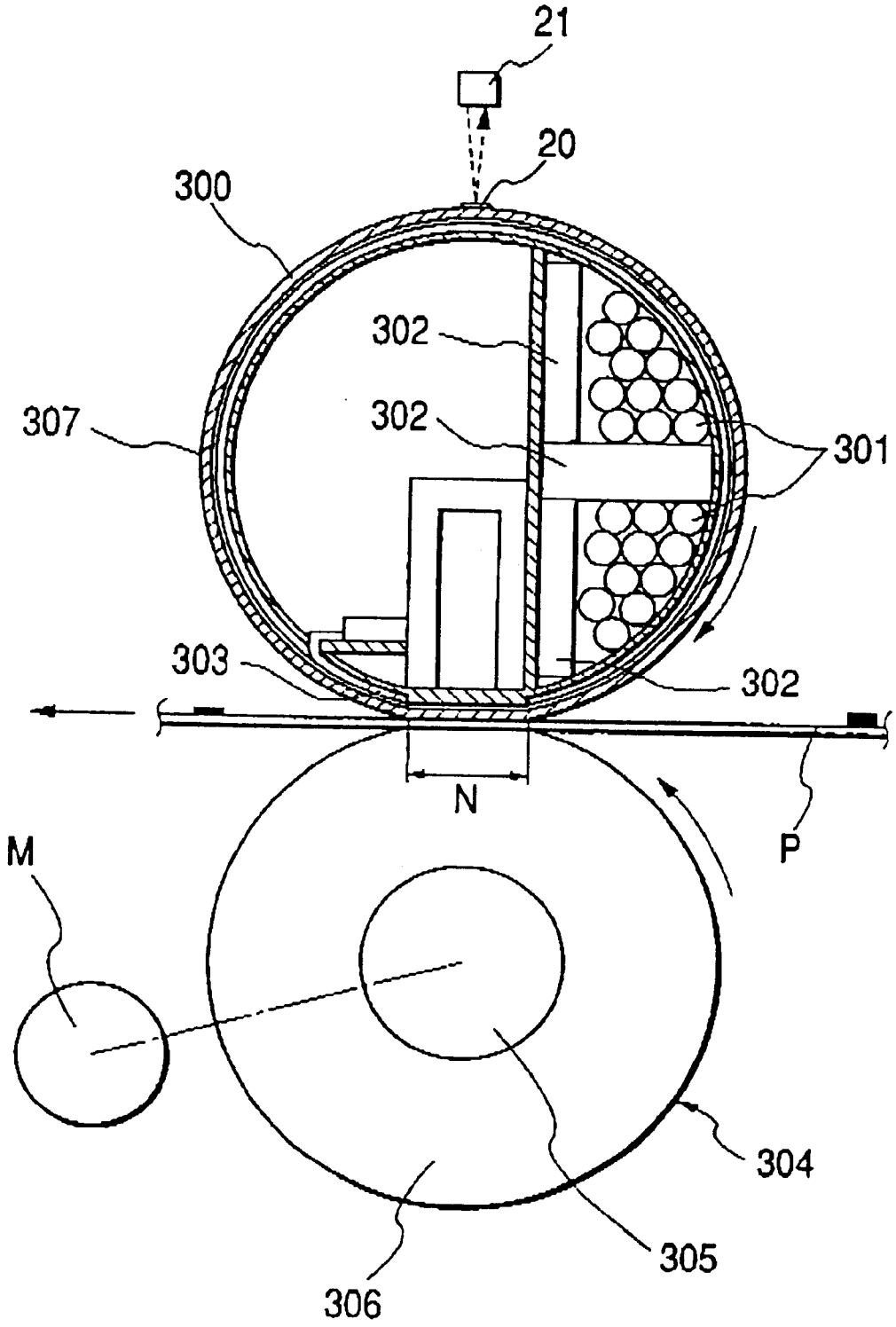
FIG. 14 shows an induction heating apparatus.

Also, the heating member is not restricted to a ceramic-heater, but can be, for example, an electromagnetic induction heat generating member. Also, as shown in FIG. 14, the film itself can include an electromagnetic induction heat generating member or an electromagnetic induction heat generating layer. The reference numeral 300 designates film, the reference numeral 301 denotes a coil, the reference numeral 302 designates a core, the reference numeral 303 denotes a temperature detecting element, the reference numeral 304 designates a driving, pressing roller, the reference numeral 305 denotes a mandrel, the reference numeral 306 designates an elastic (rubber) layer, reference letter M denotes a fixing apparatus driving motor, and the reference numeral 307 denotes a film guide.

The pressing member is not restricted to a roller member, but may be other rotary member such as a rotatable belt.

Another embodiment of the present invention will now be described.

Figure 15:
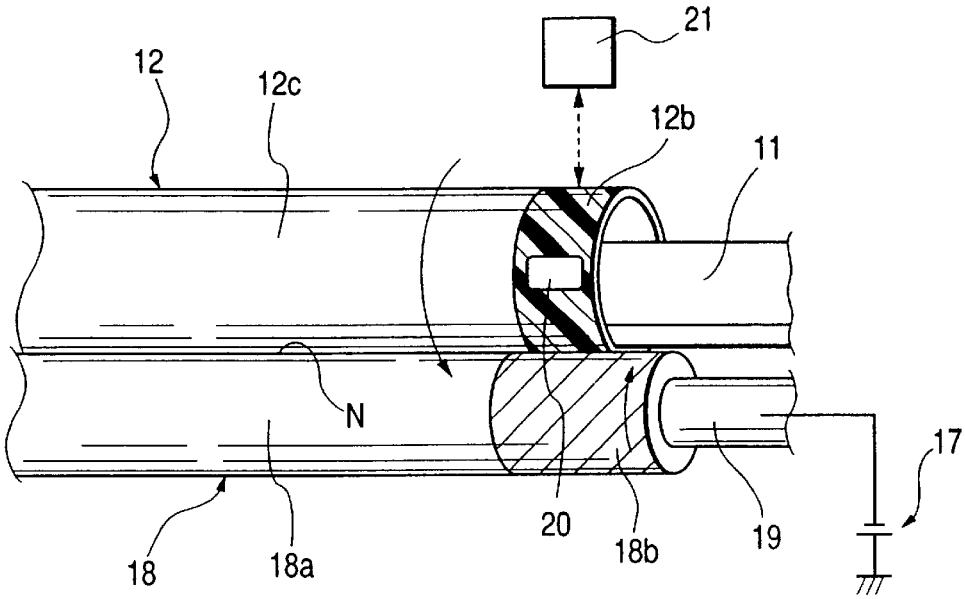
FIG. 15 shows the end portion of film provided with a marking.

As shown in FIG. 15, a portion of film which is outside the sheet passing area is coated with a reflecting material (marking) 20.

The reference numeral 18 designates a pressing roller as a rotary member forming a fixing portion N which is a pressure contact nip with the film 12 interposed between it and a heater 13, and driving the film 12, and comprising a core shaft 18*b* of aluminum, iron, stainless or like material, and a roller portion 18*a* fitted on this shaft and having a thickness of 3 mm and an outer diameter of 20 mm and formed of a heat-resisting rubber elastic material such as silicone rubber good in parting property. Also, on the surface of the pressing roller, there is provided a coat layer having fluorine resin dispersed therein for the reasons of the conveying property of the recording material P and the fixing film 12 and the prevention of the staining of the toner.

Also, on the end portion of the roller portion 18*a,* there is an electrically conducting portion 19 formed of electrically conductive rubber or the like which is in pressure contact with the primer layer (electrically conductive layer) 12*b* of the film 12 and forms a nip. When a bias voltage is applied to the roller shaft 18*b* by a bias applying device 17 through an electrically conductive bearing, not shown, the bias voltage is applied to the TOP layer of the film 12 through the electrically conductive nip portion. By the bias voltage being applied to the TOP layer, the adherence of the toner to the TOP layer is mitigated.

Description will now be made of the detailed construction and manufacturing method of the marking.

Figure 16:
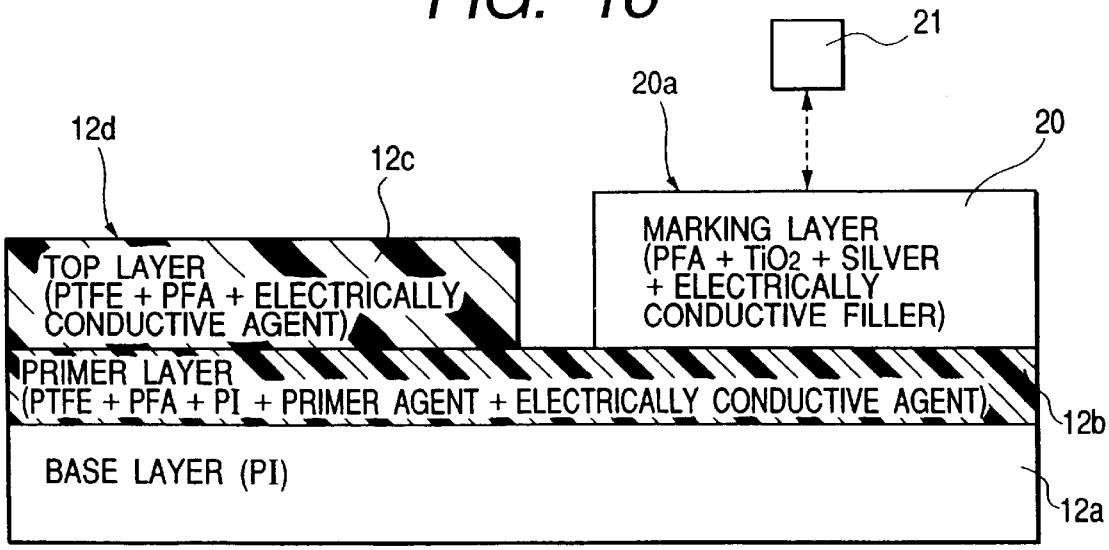
FIG. 16 shows the film and a marking portion.

FIG. 16 shows the construction of a marking portion for effecting detection using a reflection type sensor.

FIG. 16 is a cross-sectional view of the marking portion 20, and the fixing film 12 is of three-layer structure comprising a base layer 12*a* of polyimide (PI) or the like, a primer layer 12*b* superposed on the base layer 12*a* and formed of fluorine resin (PTFE and PPA) mixed with polyimide, and a top coat layer 12*c* further provided thereon and coated with fluorine resin distributed therein and sintered. The marking portion 20 is of a construction in which during the sintering of the fixing film 12, the primer layer 12*b* was sintered on the surface of the base layer 12*a,* whereafter the end portion of the film was masked and the top coat layer 12*c* was applied thereto, and with PFA resin as a base, high reflectance powder, e.g. titanium dioxide powder, calcium (calcium type) artificial pearl powder, silver paste, electrically conductive filler or the like was distributed and applied onto the primer layer of the masked end portion at a predetermined percentage, and the two were re-sintered at a time.

Figure 17:
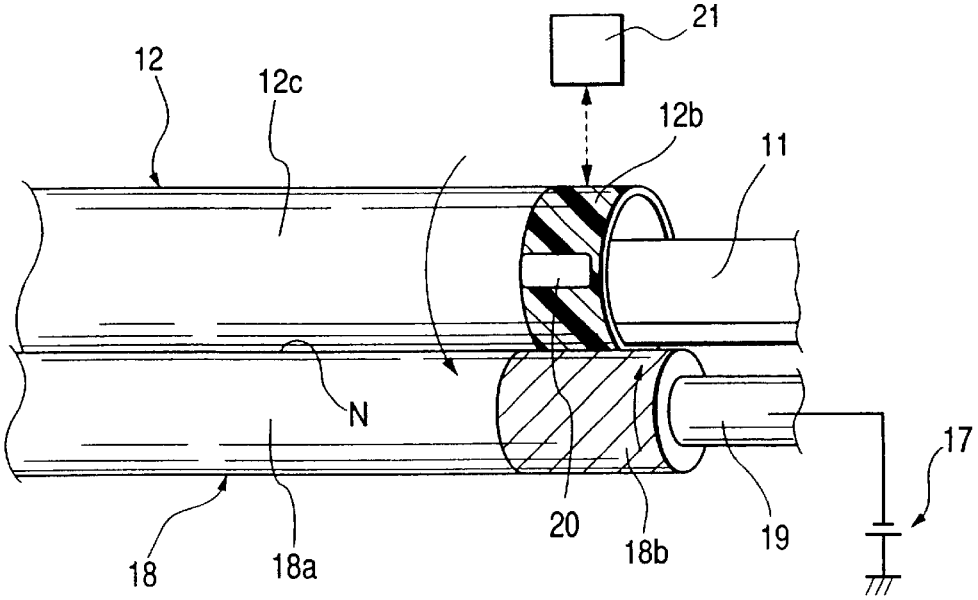
FIG. 17 shows the end portion of film provided with a marking.
Figure 18:
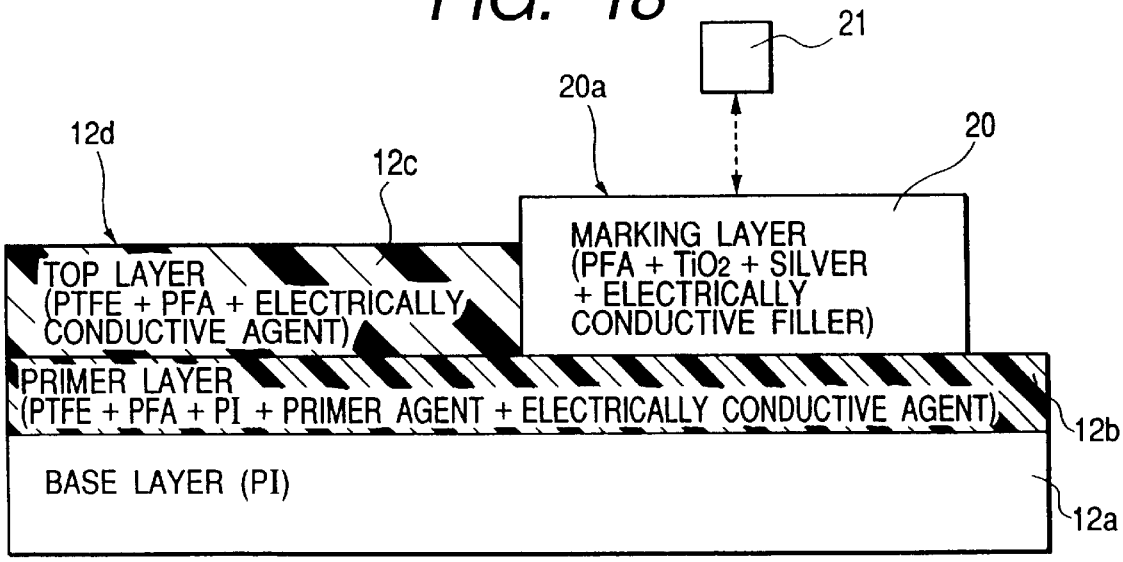
FIG. 18 shows the film and a marking portion.

The surface of this marking portion 20 is higher in reflectance than the top coat layer around it and has distributed therein fluorine resin having a good parting property and therefore, the reflectance thereof is not reduced even if the toner or the like adheres to the surface. Also, the marking portion 20 has its interior and surface made electrically conductive by silver paste, electrically conductive filler or the like, and the TOP layer and the marking layer are in non-contact with each other, but the marking layer, the primer layer and the TOP layer electrically conduct with one another, and electrical conduction is secured for a marking surface layer 20*a* and a TOP surface layer FIGS. 17 and 18 show an example in which the TOP layer and the marking layer are in contact with each other. In this example, the marking layer and the TOP layer made electrically conductive are in contact with each other to thereby secure electrical conduction. FIG. 17 is a perspective view of the end portion of the film in the present example. The basic construction of the present example is the same as that of FIG. 16.

As described above, according to the present embodiment, the marking portion is formed of a fluorine (fluorine series) material and is manufactured by being sintered integrally with the film and therefore, is low in danger such as peeling and resistant to stain as well as high in reliability. Also, by making the marking layer electrically conductive, it becomes possible to form an electrically conductive layer on the primer layer provided for charge supply on the end portion, and the TOP layer and the marking layer are successively applied onto the sintered primer layer by the use of masking so that the two may not overlap each other, whereby re-sintering is possible at the same time, and the frequency of sintering becomes smaller by once than in the construction of discrete sintering in which the marking layer is put on the TOP layer, and this leads to the merit that the damage of the film by re-sintering is decreased and the manufacturing cost is reduced. Also, there is the merit that it becomes possible to apply a bias voltage to the TOP surface layer and the contamination of the film by the toner and paper powder is mitigated.

As described in detail above, according to the present invention, with regard to the heating apparatus of the pressing member driving type and the film heating type, the evil by a fluctuation in the speed of pinching and conveying the material to be heated can be eliminated without the conveying distance of the material to be heated to the processing portion upstream of the heating apparatus being lengthened, and accordingly without the main body of the apparatus being made bulky.

Also, in an image forming apparatus provided with the heating apparatus as an image heating and fixing apparatus, the disturbance of an image attributable to the variation in the recording material conveying speed by the thermal expansion of the pressing member can be prevented.

While the embodiments of the present invention have been described above, the present invention is not restricted to the above-described embodiments, but all modifications are possible within the technical idea of the present invention.

What is claimed is:

1. An image heating apparatus comprising:

a rotary member contacting with a recording material bearing an image thereon, the image on the recording material being heated by heat from said rotary member side;

a marking portion provided on said rotary member; and detecting means for detecting a rotational speed of said rotary member by reflected light from said marking portion;

said marking portion having a mixture of an adhesive agent and a reflective material.

2. An image heating apparatus according to claim 1, wherein said reflective material is titanium dioxide powder or calcium artificial pearl powder.

3. An image heating apparatus according to claim 1, wherein said marking portion has a parting layer on a surface thereof.

4. An image heating apparatus according to claim 1, further comprising a driving roller contacting with said rotary member and driving said rotary member.

5. An image heating apparatus according to claim 4, wherein a rotational speed of said driving roller is controlled by the rotational speed detected by said detecting means.

6. An image heating apparatus according to claim 4, wherein an unfixed image is fixed on the recording material at a portion of contact between said rotary member and said driving roller.

7. An image heating apparatus according to claim 1, wherein said detecting means has a light emitting element and a light receiving element.

8. An image heating apparatus according to claim 1, wherein said rotary member is an endless film.

9. An image heating apparatus according to claim 8, further comprising a heating member sliding relative to said film, wherein the image is heated by heat from said heating member via said film.

10. An image heating apparatus according to claim 8, further comprising magnetic flux producing means for producing a magnetic flux, wherein said film generates heat by said magnetic flux producing means.

11. An image heating apparatus comprising:

a rotary member contacting with a recording material bearing an image thereon, the image on the recording material being heated by heat from said rotary member side;

a marking portion provided on said rotary member; and detecting means for detecting a rotational speed of said rotary member by reflected light from said marking portion;

said marking portion having a spherical reflecting member.

12. An image heating apparatus according to claim 11, wherein said reflecting member is formed of lead or glass.

13. An image heating apparatus according to claim 11, further comprising an adhesive agent for adhesively securing said reflecting member, wherein when a diameter of said reflecting member is D and the thickness of said adhesive agent is t, $\frac{1}{2} D<t<D$.

14. An image heating apparatus according to claim 11, wherein said marking portion has a parting layer on a surface thereof.

15. An image heating apparatus comprising:

a rotary member contacting with a recording material bearing an image thereon, the image on the recording material being heated by heat from said rotary member side;

a marking portion provided on said rotary member; and detecting means for detecting a rotational speed of said rotary member by reflected light from said marking portion;

said marking portion having a metallic member.

16. An image heating apparatus according to claim 15, wherein said metallic member is formed of aluminum.

17. An image heating apparatus according to claim 15, wherein said marking portion has a parting layer on a surface thereof.

18. An image heating apparatus comprising:

a rotary member contacting with a recording material bearing an image thereon, the image on the recording material being heated by heat from said rotary member side;

a marking portion provided on said rotary member; and detecting means for detecting a rotational speed of said rotary member by reflected light from said marking portion;

said marking portion having a reflecting member directly deposited by evaporation on said rotary member.

19. An image heating apparatus comprising:

a rotary member contacting with a recording material bearing an image thereon, said rotary member having a base layer and a surface parting layer, and the image on the recording material being heated by heat from said rotary member side;

a marking portion provided on said rotary member; and detecting means for detecting a rotational speed of said rotary member by reflected light from said marking portion;

said marking portion being a portion on which said surface parting layer is partly not provided and said base layer is exposed.

20. An image heating apparatus according to claim 19, wherein said base layer is formed of polyimide resin, and said surface parting layer is formed of fluorine resin.

21. An image heating apparatus comprising:

a rotary member contacting with a recording material bearing an image thereon, the image on the recording material being heated by heat from said rotary member side;

a marking portion provided on said rotary member; and detecting means for detecting a rotational speed of said rotary member by reflected light from said marking portion;

said rotary member having a slit, said marking portion having a reflecting member wound through said slit.

22. An image heating apparatus comprising:

a rotary member contacting with a recording material bearing an image thereon, the image on the recording material being heated by heat from said rotary member side;

a marking portion provided on said rotary member; and detecting means for detecting a rotational speed of said rotary member by reflected light from said marking portion;

said marking portion being a hole, and having a reflecting member on a back side of said hole.

23. An image heating apparatus comprising:

a rotary member contacting with a recording material bearing an image thereon, the image on the recording material being heated by heat from said rotary member side; and a marking portion provided on said rotary member for detecting a rotational speed of said rotary member;

said marking portion differing in surface resistance, dielectric constant or magnetism from the other portion with respect to a circumferential direction of said rotary member.

24. An image heating apparatus comprising:

a rotary member contacting with a recording material bearing an image thereon, the image on the recording material being heated by heat from said rotary member side;

a marking portion provided on said rotary member; and detecting means for detecting a rotational speed of said rotary member by reflected light from said marking portion;

said rotary member having a base layer, a surface parting layer, and a primer layer provided between said base layer and said surface parting layer;

said marking portion having a mixture of a material of said surface parting layer and a reflective material.

25. An image heating apparatus according to claim 24, wherein said reflective material is titanium dioxide powder or calcium artificial pearl powder.

26. An image heating apparatus according to claim 24, wherein said marking portion has a parting layer on a surface thereof.

27. An image heating apparatus according to claim 24, wherein said marking portion has a mixture of a material of said primer layer and the reflective material.

28. An image heating apparatus according to claim 24, wherein said marking portion is provided on said base layer on which said surface parting layer and said primer layer are partly not provided.

29. An image heating apparatus according to claim 24, wherein said marking portion is provided on said surface parting layer.

30. An image heating apparatus according to claim 24, further comprising a driving roller contacting with said rotary member and driving said rotary member.

31. An image heating apparatus according to claim 30, wherein a rotational speed of said driving roller is controlled by the rotational speed detected by said detecting means.

32. An image heating apparatus according to claim 30, wherein an unfixed image is fixed on the recording material at a portion of contact between said rotary member and said driving roller.

33. An image heating apparatus according to claim 24, wherein said detecting means has a light emitting element and a light receiving element.

34. An image heating apparatus according to claim 24, wherein said rotary member is an endless film.

35. An image heating apparatus according to claim 34, further comprising a heating member sliding relative to said film, wherein the image is heated by heat from said heating member via said film.

36. An image heating apparatus according to claim 34, further comprising magnetic flux producing means for producing a magnetic flux, wherein said film generates heat by said magnetic flux producing means.

37. An image heating apparatus comprising:

a rotary member contacting with a recording material bearing an image thereon, the image on the recording material being heated by heat from said rotary member side;

a marking portion provided on said rotary member for detecting a rotational speed of said rotary member; and voltage applying means for applying a bias voltage to said rotary member;

said marking portion having an electrical conductivity.

38. An image heating apparatus according to claim 37, wherein said rotary member has a base layer, a surface parting layer and an electrically conductive primer layer provided between said base layer and said surface parting layer, said voltage applying means applies a voltage to said primer layer, and said marking portion electrically conducts to said primer layer.

39. An image heating apparatus according to claim 38, wherein said surface parting layer is electrically conductive, and said marking portion electrically conducts to said surface parting layer.

* * * * *

UNITED STATES PATENT AND TRADEMARK OFFICE

CERTIFICATE OF CORRECTION

PATENT NO. : 6,408,146 B1
DATED : June 18, 2002
INVENTOR(S) : Toshiyuki Nagano

It is certified that error appears in the above-identified patent and that said Letters Patent is hereby corrected as shown below:

Title page,
Item [30], Foreign Application Priority Data, "Apr. 23, 1999 (JP) …..11-122173" should read -- Apr. 28, 1999 (JP) …..11-122173 --.

Column 1,
Line 6, "copier" should read -- copier, --.
Line 7, "a" should read -- an --.
Line 58, "is" should read -- is --.

Column 7,
Line 13, "It" should read -- it --.

Column 10,
Line 54, "Is" should read -- is --.

Column 15,
Line 55, "layer" should read -- layer 12d. --.

Signed and Sealed this

Tenth Day of December, 2002

JAMES E. ROGAN
*Director of the United States Patent and Trademark Office*